US006441333B1

(12) United States Patent
Goto et al.

(10) Patent No.: US 6,441,333 B1
(45) Date of Patent: Aug. 27, 2002

(54) GREEN COMPACT ELECTRODE FOR DISCHARGE SURFACE TREATMENT AND METHOD OF MANUFACTURING GREEN COMPACT ELECTRODE FOR DISCHARGE SURFACE TREATMENT

(75) Inventors: Akihiro Goto; Toshio Moro, both of Tokyo (JP)

(73) Assignee: Mitsubishi Denki K.K., Tokyo (JP)

( * ) Notice: Subject to any disclaimer, the term of this patent is extended or adjusted under 35 U.S.C. 154(b) by 34 days.

(21) Appl. No.: 09/639,767

(22) Filed: Aug. 15, 2000

Related U.S. Application Data

(63) Continuation of application No. PCT/JP98/01006, filed on Mar. 11, 1998.

(51) Int. Cl.[7] ..... B23H 1/04; B23H 1/06

(52) U.S. Cl. ..... 219/69.15; 219/69.11; 219/69.17

(58) Field of Search ..... 219/69.15, 69.11, 219/69.17, 118, 119, 146.21, 146.51; 75/300, 302, 308, 312

(56) References Cited

U.S. PATENT DOCUMENTS 4,373,127 A * 2/1983 Haskett et al. ..... 219/69 E
5,804,789 A * 9/1998 Saito et al. ..... 219/69.17

FOREIGN PATENT DOCUMENTS

| | | |
|---|---|---|
| JP | SHO56-126535 | 10/1981 |
| JP | SHO62-127448 | 6/1987 |
| JP | A 7-197275 | 8/1995 |
| JP | HEI9-19829 | 1/1997 |
| JP | A 9-192937 | 7/1997 |

* cited by examiner

*Primary Examiner*—M. Alexandra Elve
(74) *Attorney, Agent, or Firm*—Sughrue Mion, PLLC

(57) ABSTRACT

A green compact electrode for discharge surface treatment used for discharge surface treatment for generating discharge between a work and a green compact electrode obtained by pressuring and compacting a metal powder or a powder of a compound metal, and using the discharge energy forming a coating of an electrode material or a substance obtained through a reaction of the electrode material with the discharge energy on the work surface; the electrode is obtained by mixing a soft metal powder as a bonding agent with the metal powder or the compound metal powder, and pressuring and compacting the mixed powder.

30 Claims, 4 Drawing Sheets

GREEN COMPACT ELECTRODE FOR DISCHARGE SURFACE TREATMENT AND METHOD OF MANUFACTURING GREEN COMPACT ELECTRODE FOR DISCHARGE SURFACE TREATMENT

This application is a continuation of PCT/JP98/01006, filed Mar. 11, 1998.

1. Technological Field

The present invention relates to a green compact electrode for discharge surface treatment and a method of manufacturing the green compact electrode for discharge surface treatment and more particularly, to a green compact electrode (discharge electrode) used for discharge surface treatment to form hard anodic oxidation coatings on a work surface as well as to a method of manufacturing the green compact electrode.

2. Background Technology

Disclosed in Japanese Patent Laid-Open Publication No. HEI 9-19829 is a method of discharge surface treatment that uses a green compact electrode in the presence of a treatment liquid such as discharge treatment oil, and uses a pulse discharge between a green compact electrode and a work to form a hard anodic coating of the material of the electrode or of a substance such as metal carbide of TiC or so yielded through reaction of the electrode material on the work surface by the discharge energy.

Generally, the green compact electrode is prepared by making use of a property of the metal powder that the powder hardens when a powder of metal such as Ti is filled in a die and the metal powder in the die is pressured and compacted by a pressure punch.

The green compact electrode does not undergo sintering even when the metal powder is used, which is different from the electrode for discharge processing disclosed in Japanese Patent Laid-Open Publication No. SHO 56-126535 and Japanese Patent Laid-Open Publication No. SHO 62-127448, therefore, the electrode strength and the electric resistance finally achieved are decided depending on a state when its pressure and compacting are completed.

Therefore, in order to obtain a required final electrode strength and electric resistance, the green compact electrode requires the pressure of about 5 tonf/cm$^2$ as the compacting pressure. If the compacting pressure is lower than this, the strength of the compacted electrode may not be sufficient or the electric resistance of the electrode may become extremely large, so that the electrode can not appropriately be used as a green compact electrode for discharge surface treatment.

On the other hand, however, when an electrode is compacted with such the large compacting pressure, the pressure to the metallic die is also larger, and for this reason the green compact electrode may be chipped or broken when the green compact electrode is being taken out of the metallic die after being compacted, so that manufacture yields of the green compact electrode are resultantly low.

As described above, the requirement of a large compacting pressure for pressuring and compacting a green compact electrode for discharge surface treatment is largely caused by the facts that a linkage structure of particles can be loose only with particles of metal carbide such as TiC, and that powder can not uniformly be filled in a metallic die. The technology using a submerged discharge phenomenon has been disclosed in Japanese Patent Laid-Open Publication No. Hei. 7-197275. There has been disclosed in Japanese Patent Laid-Open Publication No. Hei. 7-197275 compression and compaction as a method of manufacturing a green compact electrode. However, with only the compression and compaction pressure distribution easily becomes non-uniform, and especially, when the size of the electrode is large it is difficult to maintain a high-quality.

The present invention has been made for solving the problems described above, and it is an object of the present invention to provide a green compact electrode for discharge surface treatment which has required electrode strength and electric resistance value as a green compact electrode for discharge surface treatment through compacting with a comparatively smaller compacting pressure and which can obtain high manufacture yields, and a method of manufacturing the green compact electrode for discharge surface treatment.

DISCLOSURE OF THE INVENTION

The present invention can provide a green compact electrode for discharge surface treatment used for discharge surface treatment for generating discharge between a work and a green compact electrode obtained by pressuring and compacting a metal powder or a powder of a compound metal, and by using the discharge energy forming a coating consisting of an electrode material or a substance obtained through reaction of the electrode material with the discharge energy on the work surface; the electrode is obtained by mixing soft metal powder with a metal powder or a powder of a compound metal, and pressuring and compacting the mixed powder.

Accordingly, when a green compact electrode is pressured and compacted, the soft metal powder enters in the inter-particle space of the metal powder or compound metal powder as a bonding agent and plastically forms in the inter-particle space to harden the electrode with powder, which makes the electric resistance of the electrode lower. With this feature, the electrode strength and electric resistance required as a green compact electrode for discharge surface treatment can be obtained even though the electrode is compacted at a low compacting pressure.

The present invention can provide a green compact electrode for discharge surface treatment in which the compound metal powder is a powder of $TiH_2$ and the soft metal powder is a powder of Ag.

Accordingly, when a green compact electrode is pressured and compacted, the Ag powder which is comparatively soft and has low electric resistance enters the inter $TiH_2$-particle space, plastically deforms in the inter-particle space and harden the electrode with powder, which makes the electric resistance of the electrode lower. With this feature, the electrode strength and electric resistance required as a green compact electrode for discharge surface treatment can be obtained even though the electrode is compacted at a low compacting pressure. In this green compact electrode, hard anodic oxidation coating of TiC is obtained in the discharge surface treatment due to a reaction of $TiH_2$ with the carbon in the treatment liquid.

The present invention can provide a green compact electrode for discharge surface treatment used for discharge surface treatment for generating discharge between a work and a green compact electrode obtained by pressuring and compacting a metal powder or a powder of a compound metal, and using the discharge energy forming a coating consisting of an electrode material or a substance obtained through a reaction of the electrode material with the discharge energy on the work surface; the electrode is obtained by mixing a bonding agent with the metal powder or the compound metal powder, and pressuring and compacting the mixed powder with a die.

Accordingly, particles of the metal powder or the compound metal powder are bonded to each other by a bonding agent to harden an electrode with powder, which make electric resistance of the electrode lower. With this feature, the electrode strength and electric resistance required as a green compact electrode for discharge surface treatment can be obtained even though the electrode is compacted at a low compacting pressure.

The present invention can provide a green compact electrode for discharge surface treatment in which the bonding agent is a carbon-contained polymer-base bonding agent such as epoxy resin or phenol resin.

Accordingly, in the discharge surface treatment, in addition to reaction of the metal powder or the compound metal powder with the carbon in treatment liquid, the metal powder or the compound metal powder reacts with the carbon in the bonding agent, so that hard carbide metal coating can be obtained.

The present invention can provide a method of manufacturing the green compact electrode for discharge surface treatment used for discharge surface treatment for generating discharge between a work and a green compact electrode obtained by pressuring and compacting the metal powder or a powder of a compound metal, and using the discharge energy forming a coating consisting of an electrode material or a substance obtained through a reaction of the electrode material with the discharge energy on the work surface; the method comprising the steps of mixing a soft metal powder with the metal powder or the compound metal powder, and pressuring and compacting the mixed powder with a die.

Accordingly, when a green compact electrode is pressured and compacted, the soft metal powder enters the inter-particle space of the metal powder or the compound metal powder as a bonding agent and plastically deforms along the inter-particle space to harden the electrode with powder, which makes the electric resistance of the electrode lower. With this feature, the electrode strength and electric resistance required as a green compact electrode for discharge surface treatment can be obtained even though the electrode is compacted at a low compacting pressure.

The present invention can provide a method of manufacturing the green compact electrode for discharge surface treatment in which the compound metal powder is a powder of $TiH_2$, and the soft metal powder is a powder of Ag.

Accordingly, when a green compact electrode is pressured and compacted, the Ag powder which is comparatively soft and has low electric resistance enters the inter-$TiH_2$-particle space and plastically deforms in the inter-particle space to harden the electrode with powder, which makes the electric resistance of the electrode lower. With this feature, the electrode strength and electric resistance required as a green compact electrode for discharge surface treatment can be obtained even though the electrode is compacted at a low compacting pressure. In this green compact electrode, hard anodic oxidation coating of TiC is obtained in the discharge surface treatment due to a reaction of $TiH_2$ with the carbon in the treatment liquid.

The present invention can provide a method of manufacturing the green compact electrode for discharge surface treatment used for discharge surface treatment for generating discharge between a work and a green compact electrode obtained by pressuring and compacting a metal powder or a powder of a compound metal, and using the discharge energy forming a coatings consisting of an electrode material or a substance obtained through a reaction of the electrode material with the discharge energy on the work surface; the method comprises the steps of filling the metal powder or the compound metal powder into a die while vibrating the die, and pressuring and compacting the powder in the die. The case of the vibration filling as described above assumes conditions as follows: several grams to hundreds of grams as a filled amount; tens of seconds as a time for vibration filling; 1–50 $\mu$m as a particle diameter; 5 $\mu$m or more as an amplitude; and 10 Hz or more as a vibration frequency.

Because of the vibration filling, the metal powder or the compound metal powder is densely filled in the die, and the metal powder or the compound metal powder can uniformly be filled in the die. With this feature, the electrode strength and electric resistance required as a green compact electrode for discharge surface treatment can be obtained even through the electrode is compacted at a low compacting pressure.

The present invention can provide a method of manufacturing the green compact electrode for discharge surface treatment in which ultrasonic vibration is applied to the die.

Because of the ultrasonic vibration filling, the metal powder or the compound metal powder is effectively densely filled in the die, and the metal powder or the compound metal powder can uniformly be filled in the die. With this feature, the electrode strength and electric resistance required as a green compact electrode for discharge surface treatment can be obtained even though the electrode is compacted at a low compacting pressure.

The present invention can provide a method of manufacturing the green compact electrode for discharge surface treatment used for discharge surface treatment for generating discharge between a work and a green compact electrode obtained by pressuring and compacting metal powder or compound metal powder, and by using the discharge energy forming a coating consisting of an electrode material or a substance obtained through reaction of the electrode material with the discharge energy on the work surface; the method comprises the steps of mixing a bonding agent with a metal powder or a compound metal powder, and pressuring and compacting the mixed powder with a die.

Accordingly, the metal powder or compound metal powder is bonded by a bonding agent to harden an electrode with powder, which make electric resistance of the electrode lower. With this feature, the electrode strength and electric resistance required as a green compact electrode for discharge surface treatment can be obtained even though the electrode is compacted at a low-compacting pressure.

The presents invention can provide a method of manufacturing the green compact electrode for discharge surface treatment in which the bonding agent is a carbon-contained polymer-base bonding agent such as epoxy resin and phenol resin.

Accordingly, in the discharge surface treatment, in addition to a reaction of the metal powder or the compound metal powder with the carbon in the treatment liquid, the metal powder or the compound metal powder reacts with the carbon in the bonding agent, so that a hard carbide metal coating can be obtained.

BEST MODE FOR CARRYING OUT THE INVENTION

Description is made for preferred embodiments of the present invention with reference to the accompanying drawings.

Embodiment 1

Figure 1:
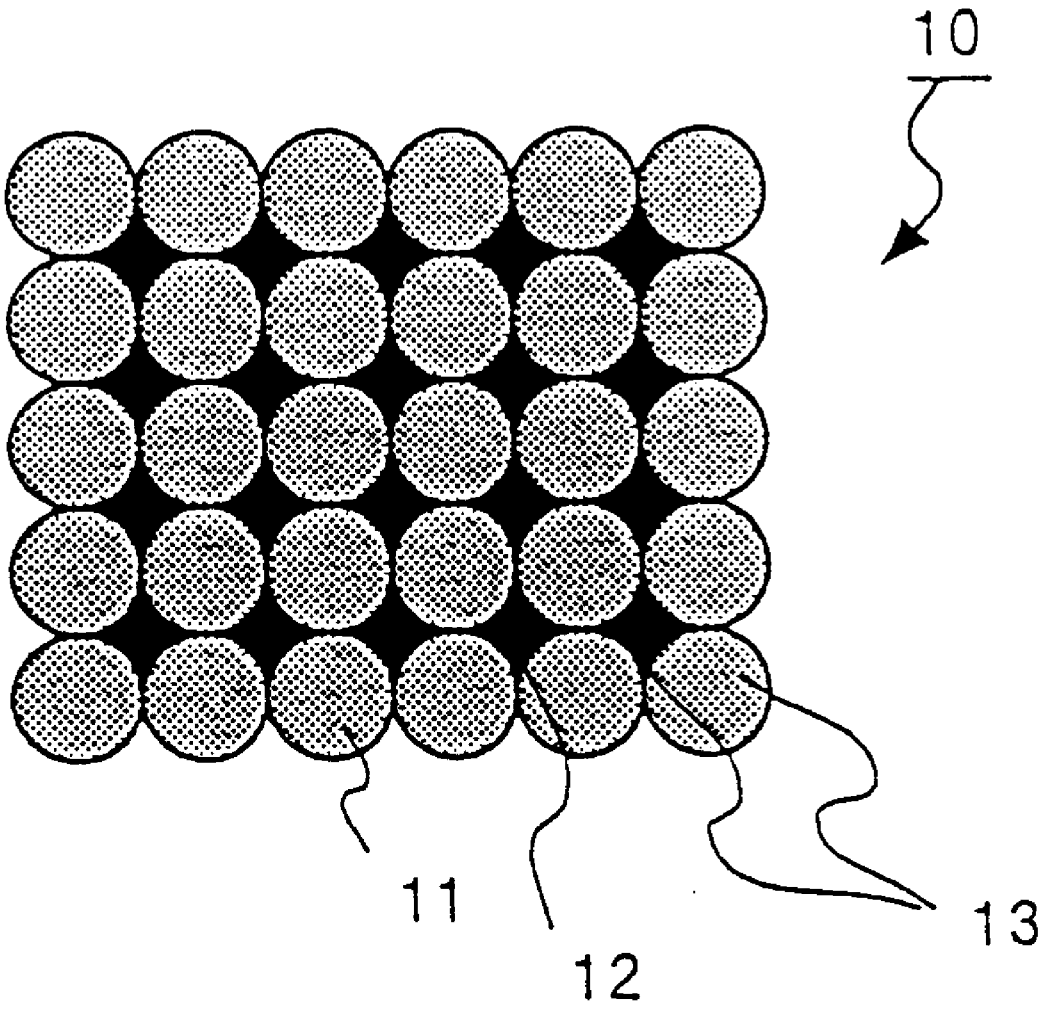
FIG. 1 is a view schematically showing an example of a microstructure of the green compact electrode for discharge surface treatment according to the present invention.

FIG. 1 schematically shows a microstructure of the green compact electrode for discharge surface treatment according to the present invention. The green compact electrode for discharge surface treatment 10 according to the present invention is obtained by pressuring and compacting the mixed powder 13 which is a mixture of a metal powder or a compound metal powder (described as metal powder hereinafter) 11 such as metal carbide as a main component of hard anodic oxidation coating yielded by discharge surface treatment and the soft metal powder 12 to a form of an electrode with a die.

The metal powder 11 is a powder of $TiH_2$(Titanium hydride), and the soft metal powder 12 is a powder of Ag.

A particle diameter of the metal powder 11 of about 1 to 40 $\mu$m may be sufficient and a particle diameter of the soft metal powder 12 of about 1 to 100 $\mu$m may be sufficient in this case, and the ratio of the metal powder 11 and soft metal powder 13 may be about 10:1 by weight percent.

Figure 2:
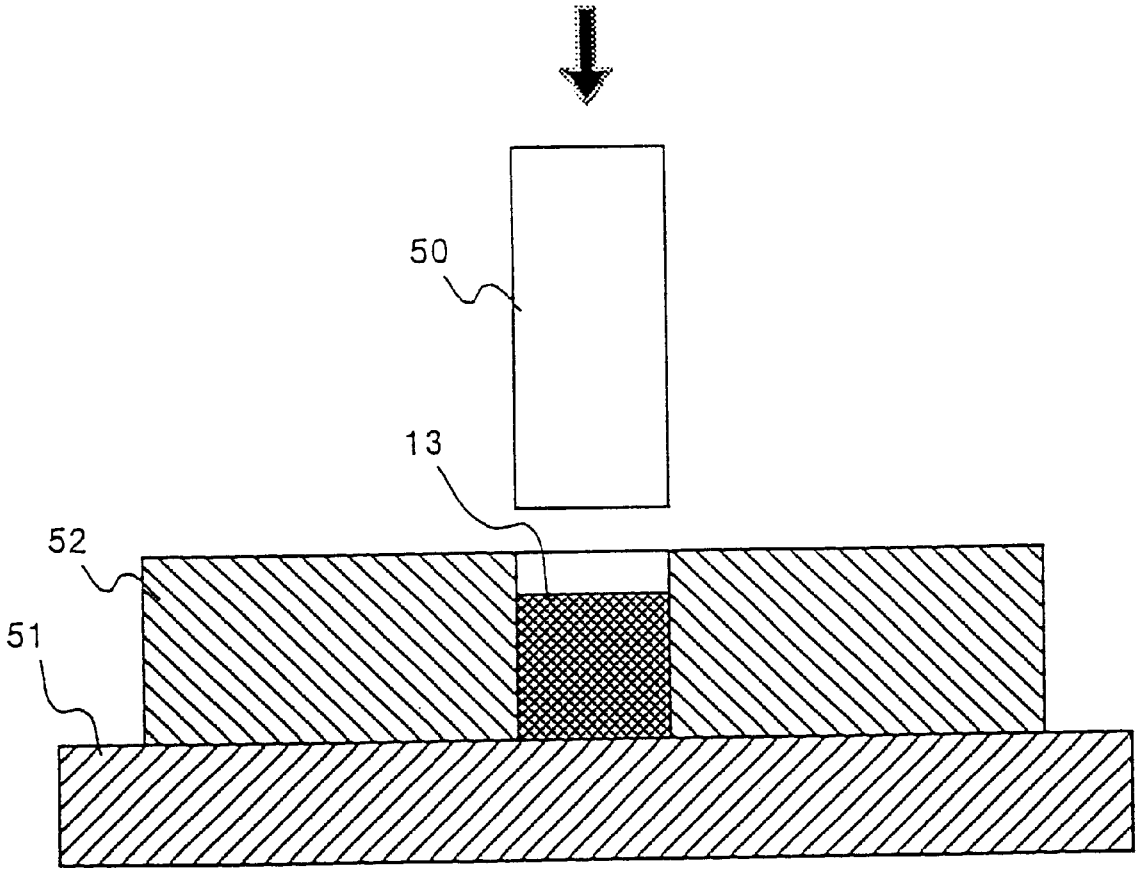
FIG. 2 is a cross-sectional view showing an example of a manufacturing device used for executing the method of manufacturing the green compact electrode for discharge surface treatment according to the present invention.

This green compact electrode for discharge surface treatment 10 is pressured and compacted by using a press punch 50 and a die 52 fixed on a die plate 51 as shown in FIG. 2, filling the mixed powder 13 of the metal powder 11 with soft metal powder 12 in the die 52, and pressuring the powder by the punch 50. The green compact electrode for discharge surface treatment 10 is pressured and compacted in a state where the soft metal powder 12 such as Ag is mixed in the metal powder 11 such as $TiH_2$, so that the green compact electrode 10 can firmly harden even when the compacting pressure for the electrode is lowered as far as around 2 tonf/cm$^2$, with which the electrode strength and electric resistance required as a green compact electrode for discharge surface treatment can be obtained.

When the green compact electrode 10 is pressured and compacted, the soft metal powder 12 enters the inter-particle space of the metal powder 11 as a bonding agent and plastically deforms in the inter-particle space, which is effective in hardening the electrode with powder as well as in making the electric resistance of the electrode lower. The electric resistance of the green compact electrode 10 can be maintained to a sufficiently low value especially by mixing thereinto Ag powder having low electric resistance.

With this, the green compact electrode for discharge surface treatment 10 having the electrode strength and electric resistance required as a green compact electrode for discharge surface treatment can be pressured and compacted with a low compacting pressure, so that the pressure to the metallic die is reduced, and therefor, the probability of chipping or breaking a green compact electrode 10 when the green compact electrode 10 is being taken out of the metallic die after being compacted is drastically reduced, and manufacture yields of the green compact electrode 10 are improved.

If the compacting pressure for an electrode is lower, the force pressed to the metallic die is smaller, which makes it possible to compact a thick green compact electrode or a slim and long green compact electrode.

With the green compact electrode 10 obtained by mixing Ag powder with $TiH_2$ powder, high-quality hard anodic oxidation coatings with TiC yielded through a reaction thereof with the carbon in the treatment liquid by the discharge energy can be obtained.

Discharge surface treatment is performed under the same conditions using the green compact electrode according to the present invention obtained by mixing Ag powder with $TiH_2$ powder, and pressuring and compacting at about 2 tonf/cm$^2$ and also the conventional type of green compact electrode obtained by pressuring and compacting at 5 tonf/cm$^2$ without mixing Ag thereinto, as a result, the properties of the coating in both of the electrodes were obtained as follows: Vickers hardness of about 2500 HV; adhesive force was strong; and the coating thickness was about 5 $\mu$m, and no difference was found in the two.

The metal powder 11 for the green compact electrode 10 could be a powder of a metal carbide or the like such as WC other than $TiH_2$, and the soft metal powder 12 to be mixed with the metal powder 11 could be a powder of a soft metal such as Au, Ag, Pb, Sn, In, and Ni other than Ag, and further a ceramics powder can also be mixed with the metal powder.

Embodiment 2

Figure 3:
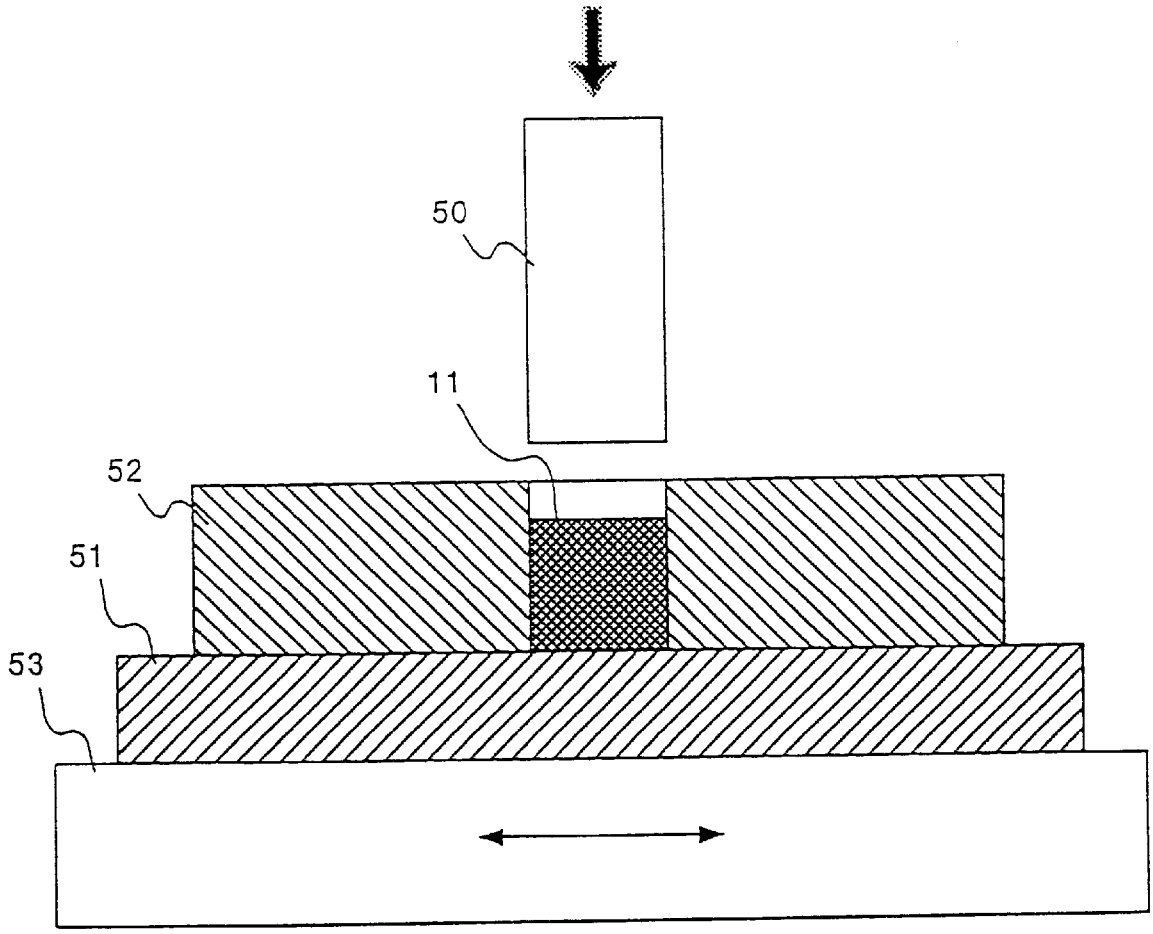
FIG. 3 is a cross-sectional view showing another example of the manufacturing device used for executing the method of manufacturing the green compact electrode for discharge surface treatment according to the present invention.

FIG. 3 shows an embodiment of the manufacturing device used for executing the method of manufacturing the green compact electrode for discharge surface treatment according to the present invention. In this embodiment, a die plate 51 is located on an exciting device 53. When metal powder 11 such as $TiH_2$ is filled in the die 52, the die 52 is vibrated using the exciting device 53, and the metal powder 11 is filled in the die 52 while the vibrations are being applied thereto.

With this processing, the density of the metal powder 11 filled in the die becomes high, so that the metal powder 11 is uniformly filled in the die 52.

The exciting device 53 may employ a device for applying ultrasonic vibrations to a die or a device for applying vibrations with a longer cycle. However, application of ultrasonic vibration thereto has the better effect when filling the metal powder densely. A vibration system which tapson a metallic die with a hammer may be employed in place of the exciting device 53.

Powder weight was compared when the metal powder 11 is completely filled in a metallic die by using the exciting device 53 and by not using the exciting device 53, and as a result, when the exciting device 53 is used, 1.3 times of powder could be filled as compared to the case when the exciting device is not used.

With this feature, it was possible to ascertain that a required green compact electrode can sufficiently be compacted even when the compacting pressure is lowered a little. Generally, when a green compact electrode is pressured and compacted without using the exciting device 53, the pressure of about 5 tonf/cm$^2$ is required for compacting, but when the exciting device 53 was used, a green compact electrode was compacted without any trouble even when the compacting pressure was lowered as far as 4 tonf/cm$^2$.

Thus, the probability of chipping or breaking of a green compact electrode when it is being taken out of the metallic die after being compacted is reduced, and manufacture yields of the green compact electrode are also improved.

It should be noted that this manufacturing method is applicable to the case where mixed powder 13 of metal powder 11 with soft metal powder 12 is used, and the same effect can be obtained. Embodiment 3

Figure 4:
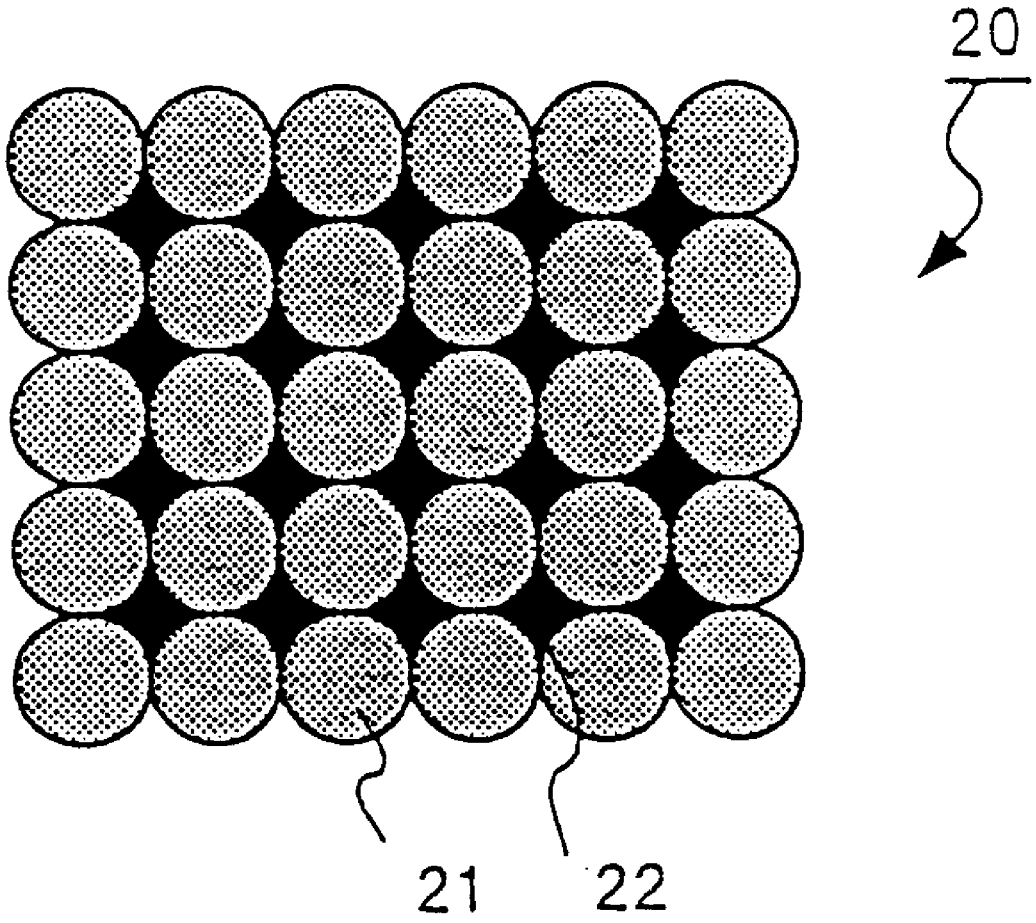
FIG. 4 is a view schematically showing another example of the microstructure of the green compact electrode for discharge surface treatment according to the present invention.

FIG. 4 schematically shows the microstructure of the green compact electrode for discharge surface treatment according to the present invention. The green compact electrode for discharge surface treatment 20 according to the present invention is obtained by mixing a bonding agent 22 into a metal powder or a compound metal powder such as metal carbide as a main component of hard anodic oxidation coatings yielded by discharge surface treatment, and further into either of the powder with ceramics powder mixed thereinto (described metal powder hereinafter) 21, and pressuring and compacting the powder to a form of an electrode with a die.

Carbon-contained polymer-base bonding agent such as epoxy resin and phenol resin may be used as a bonding agent 22.

This green compact electrode for discharge surface treatment 20 is also pressured and compacted by using the press punch 50 and the die 52 fixed on the die plate 51 as shown in FIG. 2, filling powder with the bonding agent 22 mixed into metal powder 21, and pressuring the powder by the punch 50.

The bonding agent 22 bonds the particles of the metal powder 21 to each other and acts so that a required electrode strength can be obtained. In a case of the metal powder 21 with $TiH_2$, the green compact electrode 20 can firmly harden with the bonding agent 22 even when the compacting pressure for the electrode is lowered as far as around 2 tonf/cm$^2$ or less, therefore, the electrode strength and electric resistance required as a green compact electrode for discharge surface treatment can be obtained.

With those features, the green compact electrode for discharge surface treatment 20 having the electrode strength and electric resistance required as a green compact electrode for discharge surface treatment can be pressured and compacted with a low compacting pressure, so that the pressure applied on the metallic die is reduced, therefore, the probability of chipping or breaking of a green compact electrode 20 when the green compact electrode 20 is being taken out of the metallic die after being compacted is reduced, and manufacture yields of the green compact electrode 20 are also improved.

When the bonding agent 22 is mixed in the metal powder, in addition to the action of harden the electrode, the effect of making the hardness of coatings formed through discharge surface treatment higher can also be obtained.

For example, when a green compact electrode with metal powder of $TiH_2$ is used, the main component of the coatings is TiC, that is because TiC is yielded through a reaction between Ti in the electrode with the carbon C as a component in treatment liquid. In this case, when the supply of carbon is larger than what is consumed by the green compact electrode, unreacted Ti which is not converted into TiC remains in the coating, which causes the hardness of the coatings to be lowered.

A bonding agent is decomposed by thermal energy due to discharge because it is a substance comprising carbon C, hydrogen H, and oxygen O, and hydrogen is decomposed mainly into water $H_2O$ or hydrogen gas $H_2$, oxygen into water $H_2O$ and carbon dioxide $CO_2$, and carbon into carbon dioxide $CO_2$ and carbon C. The carbon yielded herein is used when Ti in the green compact electrode reacts with TiC, which helps to form hard anodic oxidation coatings.

Namely, hard carbide metal coatings can be obtained through reaction of metal powder 21 with carbon in the bonding agent 22 in addition to reaction of metal powder 21 with carbon in treatment liquid.

INDUSTRIAL APPLICABILITY

The green compact electrode according to the present invention is applicable to a discharge electrode used for discharge surface treatment for forming hard anodic oxidation coatings thereon.

What is claimed is:

1. A green compact electrode structure for electrical discharge surface treatment of a work, comprising; a green compact electrode body formed of a pressurized compact of at least a metal powder or powder of a compound metal and a soft metal powder.

2. A green compact electrode structure according to claim 1; wherein the compound metal powder is a powder of $TiH_2$, and the soft metal powder is a powder of Ag.

3. A green compact electrode structure for electrical discharge surface treatment of a work, comprising; a green compact electrode body formed of a pressurized compact of at least a metal powder or a powder of a compound metal and a bonding agent.

4. A green compact electrode structure according to claim 3; wherein the bonding agent is a carbon-contained polymer-base bonding agent.

5. A method of manufacturing a green compact electrode structure for electrical discharge surface treatment of a work said method comprising the steps of mixing a soft metal powder a the metal powder or a compound metal powder, and pressuring and compacting the mixed powder with a die.

6. A method of manufacturing the green compact electrode structure according to claim 5; wherein the compound metal powder is powder of $TiH_2$ and the soft metal powder is a powder of Ag.

7. A method of manufacturing a green compact electrode structure for electrical discharge surface treatment of a work said method comprising the steps of filling a metal powder or a compound metal powder into a die while vibrating the die, and pressuring and compacting the powder within the die.

8. A method of manufacturing the green compact electrode structure according to claim 7; wherein ultrasonic vibration is applied to said die.

9. A method of manufacturing the green compact electrode structure for electrical discharge surface treatment of a work said method comprising the steps of mixing a bonding agent with a metal powder or a compound metal powder, and pressuring and compacting the mixed powder within a die.

10. A method of manufacturing the green compact electrode structure according to claim 9; wherein the bonding agent is a carbon-contained polymer base bonding agent.

11. A green compact electrode structure according to claim 4; wherein the bonding agent is an epoxy resin or a phenol resin.

12. A green compact electrode structure according to claim 10; wherein the bonding agent is an epoxy resin or a phenol resin.

13. A green compact electrode structure for discharge surface treatment of a work, comprising; a main body comprised of pressured and compacted powder containing a soft metal powder and a metal powder or a compound metal powder.

14. A green compact electrode structure according to claim 13, wherein the compound metal powder is a powder of $TiH_2$ and the soft metal powder is a powder of Ag.

15. A green compact electrode structure for discharge surface treatment for a work, comprising; a mixture of a pressed and compacted powder containing a bonding agent and a metal powder or a compound metal powder.

16. A green compact electrode structure according to claim 15, wherein the bonding agent is a carbon-contained polymer base bonding agent.

17. A green compact electrode structure according to claim 16, wherein the bonding agent is an epoxy resin or a phenol resin.

18. A process for producing and using a green compact electrode, comprising; mixing a soft metal powder with a metal powder or a powder of a metal compound, pressuring and compacting the mixed powder in a die, and performing electrical discharge surface treatment of a work using said green compact electrode to form a coating on said work.

19. A process for producing and using a green compact electrode according to claim 18, wherein the coating is comprised of at least one material from said electrode.

20. A process for producing and using a green compact electrode according to claim 18, wherein the coating is obtained from reacting electrode material with at least one of a work material and a dielectric.

21. A process according to claim 18, wherein the. compound metal powder is powder of $TiH_2$ and the soft metal powder is a powder of Ag.

22. A process for producing and using a green compact electrode, comprising; filling a die with a metal powder or a powder of a metal compound while vibrating the die, pressuring and compacting the powder in said die, and performing electrical discharge surface treatment of a work using said green compact electrode to form a coating on said work.

23. A process for producing and using a green compact electrode according to claim 22, wherein the coating is comprised of at least one material from said electrode.

24. A process for producing and using a green compact electrode according to claim 22, wherein the coating is obtained from reacting electrode material with at least one of a work material and a dielectric.

25. A process according to claim 20, wherein ultrasonic vibration is applied to said die.

26. A process for producing and using a green compact electrode, comprising; mixing a bonding agent with a metal powder or a powder of a metal compound in a die, pressing and compacting the mixed powder in the die, and performing electrical discharge surface treatment of a work using said green compact electrode to form a coating on said work.

27. A process for producing and using a green compact electrode according to claim 26, wherein the coating is comprised of at least one material from said electrode if formed on the work.

28. A process for producing and using a green compact electrode according to claim 26, wherein the coating is obtained from reacting electrode material with at least one of a work material and a dielectric.

29. A process according to claim 22, wherein the bonding agent is a carbon-contained polymer-base bonding agent.

30. A process according to claim 23, wherein the bonding agent is an epoxy resin or a phenol resin.

* * * * *